US012121123B2

(12) United States Patent
Eggleston et al.

(10) Patent No.: US 12,121,123 B2
(45) Date of Patent: Oct. 22, 2024

(54) COLLECTIBLE CASING CARD

(71) Applicant: The Upper Deck Company, Carlsbad, CA (US)

(72) Inventors: Michael Eggleston, Carlsbad, CA (US); Grant Sandground, Carlsbad, CA (US)

(73) Assignee: The Upper Deck Company, Carlsbad, CA (US)

( * ) Notice: Subject to any disclaimer, the term of this patent is extended or adjusted under 35 U.S.C. 154(b) by 212 days.

(21) Appl. No.: 17/013,804

(22) Filed: Sep. 7, 2020

(65) Prior Publication Data

US 2021/0085049 A1 Mar. 25, 2021

Related U.S. Application Data

(60) Provisional application No. 62/902,829, filed on Sep. 19, 2019.

(51) Int. Cl.
*A45C 11/16* (2006.01)
*B65B 5/04* (2006.01)
*B65B 61/26* (2006.01)

(52) U.S. Cl.
CPC ..... *A45C 11/16* (2013.01); *B65B 5/04* (2013.01); *B65B 61/26* (2013.01)

(58) Field of Classification Search
CPC ..... A45C 11/16; B65B 5/04; B65B 61/25
USPC ..... 206/461, 463, 467, 468, 756, 769, 770, 206/771, 6.1, 366
See application file for complete search history.

(56) References Cited

U.S. PATENT DOCUMENTS 1,987,804 A * 1/1935 Saulsbury ..... B65D 5/5206 206/214
3,351,186 A * 11/1967 Harris ..... A47F 7/03 206/6.1
3,937,319 A * 2/1976 Roy ..... A45C 11/16 206/559
5,082,110 A * 1/1992 Hager ..... A63B 47/00 D11/131
6,029,807 A * 2/2000 Love ..... B65D 85/48 206/0.82
6,494,316 B1 * 12/2002 Bloch ..... A47F 7/02 206/6.1
6,681,953 B2 * 1/2004 Au ..... A45C 11/10 220/815

(Continued)

*Primary Examiner* — Jacob K Ackun
(74) *Attorney, Agent, or Firm* — ROEDER & BRODER LLP; James P. Broder; Devin R. Vaage

(57) ABSTRACT

A collectible casing card can include a casing member, a card member that is engaged with the casing member to define a casing member interior, and a collectible that is positioned within the casing member interior. The card member and casing member can be engaged to form a flush or non-flush engagement. The collectible casing card can include a fastener that is secured to one of the casing member and the card member. The fastener can be positioned on a side wall of the card member. The collectible can include a ring. A method for manufacturing a collectible casing card can include the steps of engaging a card member and a casing member with one another to define a casing member interior and positioning the collectible within the casing member interior. The method can include the step of imprinting an image on a top surface of the card member.

20 Claims, 3 Drawing Sheets

(56) References Cited

U.S. PATENT DOCUMENTS

| | | | | |
|---|---|---|---|---|
| 6,776,290 | B2 * | 8/2004 | Augustine | G09F 1/12 206/758 |
| 6,918,488 | B2 * | 7/2005 | Renhed | B65D 83/08 229/101 |
| 8,458,933 | B2 * | 6/2013 | Tahan | A47F 7/00 40/538 |
| 8,573,397 | B1 * | 11/2013 | Fager | B65B 61/26 206/320 |
| 2005/0150795 | A1 * | 7/2005 | Kershaw | A47F 7/00 206/315.9 |
| 2007/0187266 | A1 * | 8/2007 | Porter | B42F 7/025 206/459.5 |
| 2007/0227943 | A1 * | 10/2007 | Foushee | B65D 5/5007 206/734 |
| 2009/0139897 | A1 * | 6/2009 | Gilstrap | B65D 77/006 206/769 |
| 2009/0166228 | A1 * | 7/2009 | Kinunen | G09F 19/00 206/1.5 |
| 2013/0146487 | A1 * | 6/2013 | Macor | B65D 85/58 206/232 |

* cited by examiner

COLLECTIBLE CASING CARD

RELATED APPLICATION

This application claims priority on U.S. Provisional Application Ser. No. 62/902,829, filed on Sep. 19, 2019, and entitled "COLLECTIBLE CASING CARD". To the extent permitted, the contents of U.S. Provisional Application Ser. No. 62/902,829 are incorporated in their entirety herein by reference.

BACKGROUND

Sports collectibles or memorabilia generally refers to a souvenir, a memento and/or a keepsake that is directly connected to past, present and future athletes, sports teams and/or sporting events, whether it be professional or non-professional (i.e., semi-professional, collegiate, amateur, etc.). Sports collectibles often include awards, such as medals, plaques, trophies and/or rings, photos, sculptures, trading cards, signatures and/or game-used items, including uniforms and/or other related sports equipment.

Acquiring sports collectibles has been a popular pastime that provides great satisfaction for many people. This can include the fun of searching for and finding new memorabilia, the pride of possession associated with owning something unique, a genuine admiration for the beauty and craftsmanship of an item, a connection with a favorite athlete or sports team, a real desire to have ties with the past, and the related feelings of nostalgia for sport in another time and place. More pragmatically, obtaining sports collectibles can also provide personal gratification of knowing that what one has acquired is a good financial investment.

SUMMARY

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

The present invention is directed toward a collectible casing card. In certain embodiments, the collectible casing card can include a casing member, a card member that is engaged with the casing member to define a casing member interior, and a collectible that is positioned within the casing member interior.

In some embodiments, the card member and the casing member can be engaged to form a flush engagement.

In certain embodiments, the card member and the casing member can be engaged to form a non-flush engagement.

In various embodiments, the collectible casing card can include a fastener that can be secured to one of the casing member and the card member.

In some embodiments, the fastener can include one of a clamp, a setting, a latch and a clasp.

In certain embodiments, the fastener can be positioned on a side wall of the card member.

In various embodiments, the collectible can include a ring.

In some embodiments, the collectible can include at least a portion of a game-used item.

In certain embodiments, the collectible casing card can include an image imprinted on a top surface of the card member.

In various embodiments, the image can include at least one of written indicia, a photograph, a graphic, a digital image, artwork, a computer-generated image and a sporting logo.

In various embodiments, the collectible casing card can include a base card that is adhered to the casing member.

The present invention is also directed toward a method of manufacturing the collectible casing card including any of the above embodiments.

The present invention is also directed toward a method for manufacturing a collectible casing card. In some embodiments, the method can include the steps of engaging a card member and a casing member with one another to define a casing member interior and positioning a collectible within the casing member interior.

In certain embodiments, the step of engaging can include adhering the card member with the casing member.

In certain embodiments, the collectible can include a ring.

In various embodiments, the step of positioning can include coupling the collectible to one of the card member and the casing member.

In some embodiments, the method can include the step of imprinting an image to a top surface of the card member.

In certain embodiments, the step of imprinting can include imprinting at least one of written indicia, a photograph, a graphic, a digital image, artwork, a computer-generated image and a sporting logo.

In various embodiments, the step of imprinting can include imprinting an autograph.

In certain embodiments, the method can include the step of adhering a base card to the casing member.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

While embodiments are susceptible to various modifications and alternative forms, specifics thereof have been shown by way of example and drawings, and will be described in detail. It should be understood, however, that the scope herein is not limited to the particular aspects described. On the contrary, the intention is to cover modifications, equivalents, and alternatives falling within the spirit and scope herein.

DESCRIPTION

Embodiments of the present invention are described herein in the context of a sports collectible casing card (hereinafter sometimes referred to simply as a "collectible casing card"). Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As an overview, in various embodiments, the collectible casing card and methods of manufacture are disclosed herein describe the formation of the collectible casing card including a casing member, a card member that is engaged with the casing member to define a casing member interior and a collectible that is positioned within the casing member interior. The collectible casing card herein can include a casing member formed from a transparent material, one of an acrylic, a glass, and a plastic. It is appreciated that the collectible casing card herein can include many different forms. The collectible casing card described herein can enclose a collectible and can have an image imprinted on a top surface.

Figure 1:
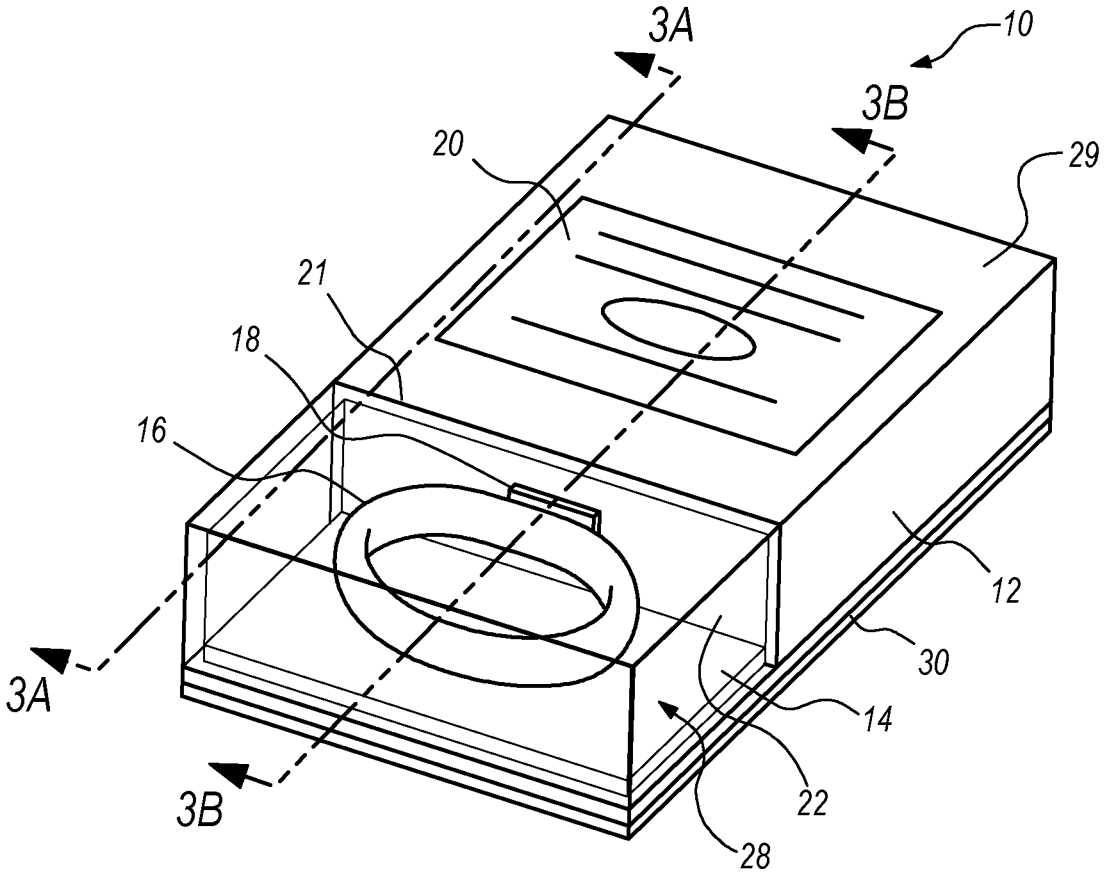
FIG. 1 is a perspective view of one embodiment of a collectible casing card having features of the present invention.

FIG. 1 is a perspective view of one embodiment of the collectible casing card 10. The design and/or configuration of the collectible casing card 10 can vary. In various embodiments, such as the embodiment illustrated in FIG. 1, the collectible casing card 10 can include one or more of a card member 12, a casing member 14, a collectible 16, a fastener 18 and an image 20. It is understood that the collectible casing card 10 can include fewer or additional components than those specifically illustrated and described herein. In FIG. 1, the collectible casing card 10 is fully assembled.

As illustrated in FIG. 1, the card member 12 and the casing member 14 engage one another. In certain embodiments, such as FIG. 1, the card member 12 and the casing member 14 can engage one another so that a flush engagement 21 occurs. In other words, the card member 12 and the casing member 14 are substantially even, level and/or equal in height with one another. In other embodiments, the card member 12 may engage the casing member 14 to create a non-flush or uneven fitting or engagement. In alternative embodiments, the card member 12 and the casing member 14 may be engaged via any other suitable manner and/or method.

In various embodiments, the casing member 14 can include one or more side walls 22. In some embodiments, the side wall 22 of the casing member 14 can include a portion of the casing member 14 that is trimmed, cut and/or altered. More specifically, the edges of the side wall 22 of the casing member 14 may be trimmed, cut and/or altered to allow for the flush engagement 21 of the card member 12 and casing member 14.

Additionally, the card member 12 can be formed from a cardstock, a cardboard, a silk, a plastic material or a paper product, as non-exclusive examples. In one embodiment, the card member 12 may be formed from one or more layers of cardstock adhered to one another. Alternatively, the card member 12 can be formed from any other suitable material. Further, the card member 12 can be formed using a 3D printer or via a similar printing manner and/or method.

In various embodiments, the casing member 14 can surround, enclose, and/or protect the collectible 16. In some embodiments, the casing member 14 can be formed from a relatively transparent material, such as an acrylic material, a plastic, or a glass, as non-exclusive examples. Alternatively, the casing member 14 can be formed from any other suitable material. Additionally, the casing member 14 can be colored and/or tinted.

In certain embodiments, the collectible casing card 10, the card member 12 and/or casing member 14 can have a shape, a size and/or a thickness that varies depending on the design requirements of the collectible casing card 10. In the embodiment illustrated in FIG. 1, the collectible casing card 10, the card member 12 and/or casing member 14 have a somewhat rectangular shape. In other embodiments, the collectible casing card 10, the card member 12 and/or the casing member 14 can have a somewhat square shape, triangular shape, trapezoidal shape, star shape, circular shape, polygonal shape, or any other suitable geometrical or non-geometrical shape. Alternatively, the collectible casing card 10, the card member 12 and/or casing member 14 can have a random shape that includes curves and/or linear edges. Additionally, and/or alternatively, the collectible casing card 10, the card member 12 and/or casing member 14 can be of any other suitable shape, size and/or thickness.

In this embodiment, the card member 12 and the casing member 14 are engaged and/or cooperate with one another to define a casing member interior 28. The casing member interior 28 surrounds, encloses and/or protects the collectible 16. The collectible 16 can include any professional and/or non-professional (i.e., semi-professional, collegiate, amateur, etc.) sports collectible and/or other collectible, including sports and/or entertainment awards, such as medals, plaques, trophies and rings, as certain non-exclusive examples. The collectible 16 may also include at least a portion of game-used items, including uniforms and/or other related sports equipment, as other non-exclusive examples. Additionally, while the embodiment illustrated in FIG. 1 specifically includes one collectible 16, such as a ring, it is understood and appreciated that the collectible casing card 10 can include more than one collectible 16. Further, in FIG. 1, the collectible 16 can be positioned within the casing member interior 28. The collectible 16 may be positioned at any location within the casing member interior 28. Alternatively, the collectible 16 can be positioned at any other location on and/or within the collectible casing card 10.

The fastener 18 fastens, secures, removably secures and/or couples the collectible 16 to the collectible casing card 10. Specifically, FIG. 1 includes the collectible 16 fastened and/or coupled to the card member 12 via the fastener 18. In certain embodiments, the fastener 18 can removably secure the collectible 16 to the collectible casing card 10. In other words, while the fastener 18 secures and/or fastens the collectible 16 to the collectible casing card 10, the collectible 16 may also be removed from the collectible casing card 10. In various embodiments, the fastener 18 can include a clip, a clamp, a setting, a clasp, a latch, Velcro, a magnet, adhesive material and/or any other device or material that secures, removably secures, fastens and/or couples the collectible 16 to the card member 12 and/or the casing member 14 in a substantially stationary or immovable position. Additionally, the fastener 18 can be formed from a plastic or a metal, as certain non-exclusive examples. Alternatively, the fastener 18 can be formed from any other suitable material.

In certain embodiments, the fastener 18 can be removed from its position on the collectible casing card 10 so that the fastener 18 can be replaced or repaired. In the embodiment illustrated in FIG. 1, the fastener 18 is positioned on the side wall 22 of the card member 12. Alternatively, the fastener 18 can be positioned on any location within the casing member interior 28. Still alternatively, the fastener 18 can be positioned at any other location on the card member 12 and/or the casing member 14. In some embodiments, the card member 12 can include one or more fasteners 18 (only one fastener 18 is illustrated in FIG. 1).

The image 20 can include a photograph, a graphic, a logo, a digital image, a computer-generated image, a hologram, and/or any form of written, printed, and/or digital indicia. In some embodiments, the image can be imprinted on the card member with the use of computers, vinyl cutter plotters, digital plotters, paint or dye sublimation and heat transfer, as certain non-exclusive examples. The image 20 can be color and/or black and white. Alternatively, the image 20 can include any other suitable format that allows the image 20 to be imprinted onto a top surface 29 of the card member 12 and/or one or more of the side walls 22 of the card member 12. In certain embodiments, the image 20 can be in a three-dimensional format, including physical printed structures and/or three-dimensional digital imagery. In this embodiment, the image 20 is imprinted on the top surface 29 of the card member 12. In alternative embodiments, the image 20 may be imprinted on any component of the collectible casing card 10. As referred to herein, the term imprinted can include stamping, embedding, adhering, printing, sealing, painting, embossing, imprinting, inscribing, etc.

In some embodiments, the image 20 can depict and/or have a relatively similar appearance to a professional or non-professional individual or team logo or other mark, trademark, or similar indicia (hereinafter sometimes collectively referred to as a "sporting logo") and/or a person such as a professional or non-professional athlete or other athletically-involved persons (hereinafter sometimes collectively referred to as an "athlete"). As used herein, a professional athlete includes any person that is/was employed and/or plays/played for a professional sports team. Further, as used herein, a non-professional athlete includes any person that is/was employed and/or plays/played for a semi-professional, collegiate and/or amateur sports team. Still further, as used herein, "athletically-involved person" includes persons such as players, former players, coaches, managers, owners, agents, team field staff, team office staff, game announcers/analysts, etc., or any other person that may be involved or associated with a sport or a sporting team. Alternatively, the image 20 can depict non-sports figures, such as celebrities, singers, influencers, entertainers, actors, historical figures, public figures, or any other suitable person, animal, character, etc.

In one embodiment, the image 20 can include an autograph. As used herein, the term "autograph" can include an actual or digital or facsimile signature, an inscription and/or an imprint (such as handprints, footprints or prints from any other suitable body part). In other words, a person can inscribe his and/or her autograph directly onto the top surface 29 of the card member 12 and/or one or more side walls 22 of the card member 12. Stated another way, the image 20 can include the autograph of a professional athlete, a non-professional athlete and/or an athletically-involved person directly on the top surface 29 of the card member 12 and/or one or more sides wall 22 of the card member 12. Alternatively, the image can include the autograph of an entertainer, public figure, celebrity, influencer, singer, actor, historical figure, etc.

While the embodiment illustrated in FIG. 1 only shows one image 20, it is appreciated that the collectible casing card 10 can include any number of images, i.e., a first image, a second image, etc.

In certain embodiments, such as in FIG. 1, the collectible casing card 10 can further include one or more base cards 30. The base card 30 can be adhered and/or secured to the casing member 14. In various embodiments, the casing member 14 and base card 30 can be adhered via any suitable manner. The base card 30 can be formed from a cardstock, a cardboard, a silk, a plastic material or a paper product, as non-exclusive examples. In one embodiment, the base card 30 may be formed from one or more layers of cardstock adhered to one another. In alternative embodiments, the base card 30 can be formed from any other suitable material.

In certain embodiments, the one or more base cards 30 can have a shape, a size and/or a thickness that varies depending on the design requirements of the collectible casing card 10. In the embodiment illustrated in FIG. 1, the one or more base cards 30 have a somewhat rectangular shape. In other embodiments, the one or more base cards 30 can have a somewhat square shape, triangular shape, trapezoidal shape, star shape, circular shape, polygonal shape, or any other suitable geometrical or non-geometrical shape. Alternatively, the one or more base cards 30 can have a random shape that includes curves and/or linear edges.

Additionally, it is understood that although FIG. 1 illustrates the components of the collectible casing card 10 in a particular position, sequence and/or order, these components can be located in any suitably different position, sequence and/or order than that illustrated in FIG. 1. It is further appreciated that the drawings included herewith are not necessarily drawn to scale. For example, in FIG. 1, the components of the collectible casing card 10 are not necessarily to scale, but are illustrated for purposes of clarity in demonstrating certain features and limitations of the collectible casing card 10.

Figure 2:
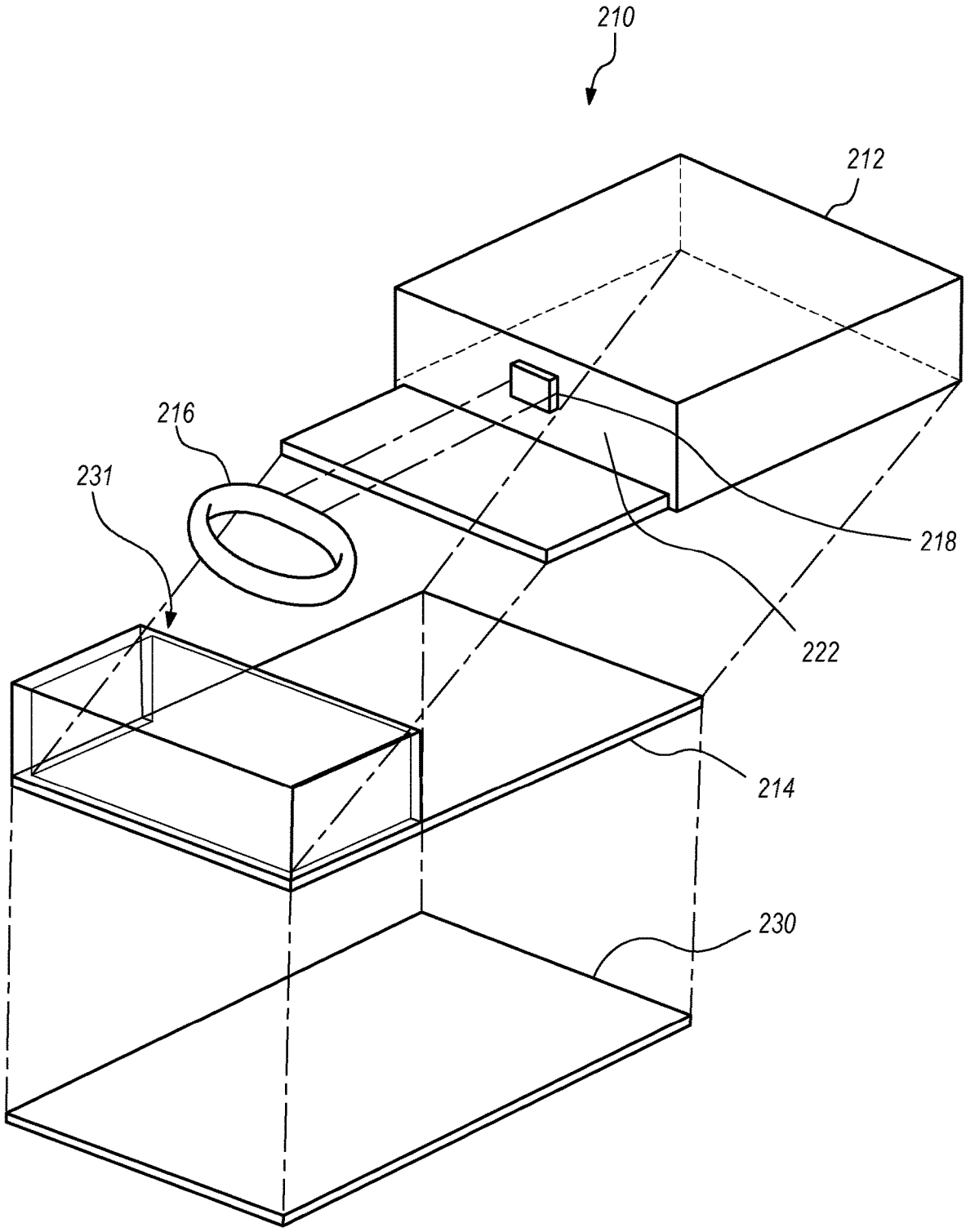
FIG. 2 is an exploded perspective view of another embodiment of the collectible casing card.

FIG. 2 is an exploded perspective view of another embodiment of the collectible casing card 210. In the embodiment illustrated in FIG. 2, the collectible casing card 210 is not fully assembled. Instead, this embodiment illustrates how the collectible casing card 210 may be assembled. In this embodiment, the collectible casing card 210 includes the card member 212, the casing member 214, the collectible 216, the fastener 218 and the base card 230.

In the embodiment illustrated in FIG. 2, the card member 212 and the casing member 214 may be engaged with one another. The card member 212 and the casing member 214 may be engaged via any suitable manner and/or method. In some embodiments, the card member 212 may be adhered and/or secured to the casing member 214. The card member 212 may be adhered and/or secured to the casing member 214 via any suitable manner or method.

In this embodiment, the casing member 214 and the base card 230 may also be adhered and/or secured to one another. In certain embodiments, such as the embodiment illustrated in FIG. 2, the casing member 14 can include a casing pocket 231. Specifically, the casing pocket 231 can surround, enclose and/or protect the collectible 216. While the casing pocket 231 has a somewhat rectangular shape, it is understood that the casing pocket 231 can have any other geometrical or non-geometrical cross-sectional shape or a random cross-sectional shape that includes curves and/or linear edges. In certain embodiments, the casing pocket 231 can have a shape, a size and/or a thickness that varies depending on the design requirements of the collectible casing card 210. In other embodiments, the casing pocket 231 can have a somewhat square shape, triangular shape, trapezoidal shape, star shape, circular shape, polygonal shape, or any other suitable geometrical or non-geometrical shape.

In the embodiment illustrated in FIG. 2, the fastener 218 is positioned on the side wall 222 of the card member 212. Additionally, the fastener 218 may fasten and/or couple the collectible 216 to the card member 212. Alternatively, the fastener 218 may be positioned on any other suitable location on the collectible casing card 210, such that the collectible may be fastened and/or coupled to any other suitable component of the collectible casing card 210. In certain embodiments, the fastener 218 can be removed from its position on the collectible casing card 210 so that the fastener 218 can be replaced and/or repaired.

Figure 3A:
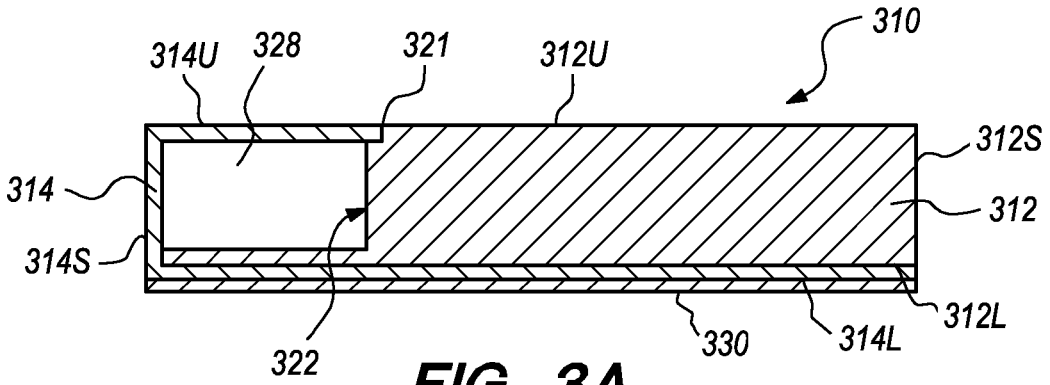
FIG. 3A is a cross-sectional view of the collectible casing card taken on line 3A-3A in FIG. 1.

FIG. 3A is a cross-sectional view of the collectible casing card 310 taken on line 3A-3A in FIG. 1. In the embodiment illustrated in FIG. 3A, the card member 312 and the casing member 314 are engaged and/or cooperate with one another to define the casing member interior 328. In this embodiment, the casing member interior 328 has a somewhat rectangular cross-sectional shape. In alternative embodiments, the casing member interior 328 can have any other geometrical or non-geometrical cross-sectional shape or a random cross-sectional shape that includes curves and/or linear edges. In certain embodiments, the casing member interior 328 can have a shape, a size and/or a thickness that varies depending on the design requirements of the collectible casing card 310. In other embodiments, the casing member interior 328 can have a somewhat square shape, triangular shape, trapezoidal shape, star shape, circular shape, polygonal shape, or any other suitable geometrical or non-geometrical shape.

Additionally, FIG. 3A illustrates the flush engagement 321 of the card member 312 and the casing member 314. In the embodiment in FIG. 3A, a portion of the card member 312 has been trimmed, cut and/or altered. More specifically, the edges or perimeter of the side wall 322 of the card member 312 have been be trimmed, cut and/or altered to allow for the flush engagement 321 between the card member 312 and casing member 314.

Further, as illustrated in FIG. 3A, the card member 312 can include a card upper surface 312U, a card lower surface 312L, and a card side surface 312S. The casing member 314 can include a casing upper surface 314U, a casing lower surface 313L, and a casing side surface 314S. As illustrated in FIG. 3A, the card upper surface 312U and the casing upper surface 314U can be flush in the flush engagement 321. In the flush engagement 321 illustrated in FIG. 3A, the card upper surface 312U and the casing upper surface 314U can be substantially (i) even, (ii) coplanar, and (iii) equal in height with one another.

As illustrated in FIG. 3A, the card upper surface 312U and the casing upper surface 314U can be substantially parallel to one another. The card lower 312L and the casing upper 314U can be substantially parallel in the flush engagement 321. Additionally, or in the alternative, the card side surface 312S and the casing side surface 314S can be substantially parallel to one another in the flush engagement 321. In this embodiment, the card side surface 312S and the casing side surface 314S can be substantially orthogonal to one or more of (i) the card upper surface 312U, (ii) the card lower surface 312L, (iii) the casing upper surface 314U, and (iv) the casing lower surface 314L in the flush engagement 321.

Figure 3B:
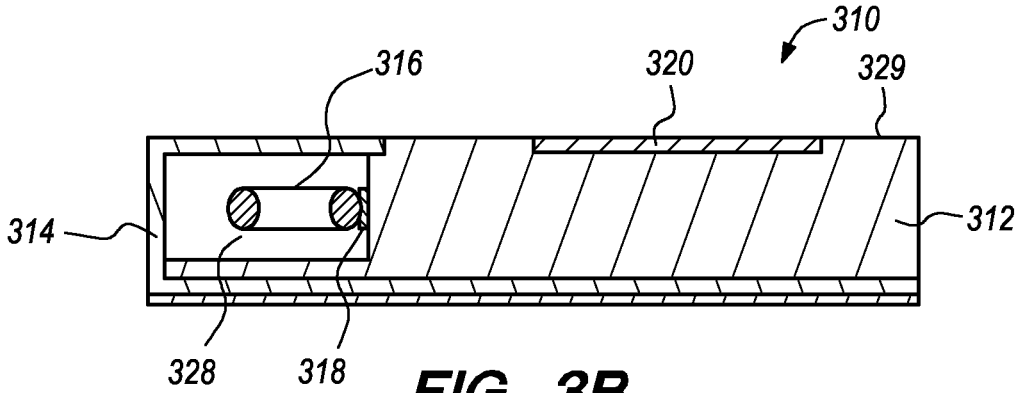
FIG. 3B is a cross-sectional view of the collectible casing card taken on line 3B-3B in FIG. 1.

FIG. 3B is a cross-sectional view of the collectible casing card 310 taken on line 3B-3B in FIG. 1. In the embodiment illustrated in FIG. 3B, the card member 312 and the casing member 314 are engaged and/or cooperate with one another to define the casing member interior 328. FIG. 3B further illustrates the collectible 316 and the fastener 318 being positioned within the casing member interior 328. The collectible 316 and the fastener 318 can be positioned at any location within the casing member interior 328.

FIG. 3B includes one image 320 that has been embossed and/or carved into the top surface 329 of the card member 312. In other embodiments, the image 320 may be imprinted on top of the top surface 329 of the card member 312.

Figure 4:
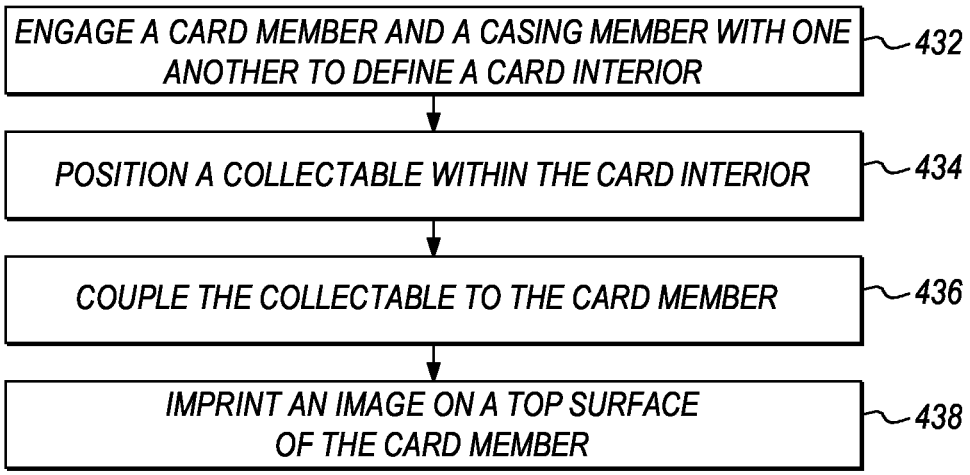
FIG. 4 is a flowchart outlining one embodiment of a method for making the collectible casing card.

FIG. 4 is a flowchart illustrating one embodiment of a method for making the collectible casing card 410. It is appreciated that the order of the steps illustrated and described in FIG. 4 is not necessarily indicative of how the method of making functions chronologically, as one or more of the steps can be combined, reordered, and/or performed simultaneously without deviating from the intended breadth and scope of the method for making the collectible casing card 410. It is understood that one or more steps illustrated in FIG. 4 can be omitted, and/or additional steps can be included which are not necessarily shown or described herein.

At step 432, the card member and the casing member engage one another. The card member and the casing member can engage one another via any suitable manner or method. For example, the card member and the casing member may be engaged in such a manner as to create the flush engagement. In certain embodiments, the card member and the casing member can be engaged and/or cooperate with one another to define the casing member interior. Additionally, the card member may be adhered and/or secured to the casing member. The card member may be adhered and/or secured to the casing member via any suitable manner or method.

At step 434, the collectible is positioned within the casing member interior, such that the casing member interior may surround, enclose and/or protect the collectible. The collectible can be positioned at any location within the casing member interior. Alternatively, the collectible can be positioned at any other location or component on or within the collectible casing card.

At step 436, the collectible is fastened, secured and/or coupled to the card member. For example, in certain embodiments, the collectible can be fastened, secured and/or coupled with the fastener. As non-exclusive examples, the fastener can include a clamp, a setting, a clasp, a latch, Velcro, a magnet, adhesive material and/or any other device or material that fastens and/or couples the collectible to the card member and/or the casing member in a substantially stationary or immovable position. Alternatively, the collectible may be fastened, secured and/or coupled to the card member via any suitable manner or method. Still alternatively, the collectible may be fastened, secured and/or coupled to the casing member.

At step 438, the image can be imprinted on at least a portion of the collectible casing card. For example, in one embodiment, the image can be imprinted on the top surface of the card member and/or one or more side walls of the card member. In certain embodiments, the image may include sporting logos, professional athletes, non-professional athletes, other athletically-involved persons, entertainers, celebrities, influencers, historical figures, public figures, etc. The image can be imprinted onto the card member via any suitable manner or method. In some embodiments, the image can be imprinted on the card member with the use of computers, vinyl cutter plotters, digital plotters, paint or dye sublimation and heat transfer, as certain non-exclusive examples.

It should be noted that, as used in this specification and the appended claims, the singular forms "a," "an," and "the" include plural referents unless the content and/or context clearly dictates otherwise. It should also be noted that the term "or" is generally employed in its sense including "and/or" unless the content or context clearly dictates otherwise.

The headings used herein are provided for consistency with suggestions under 37 CFR 1.77 or otherwise to provide organizational cues. These headings shall not be viewed to limit or characterize the invention(s) set out in any claims that may issue from this disclosure. As an example, a description of a technology in the "Background" is not an admission that technology is prior art to any invention(s) in this disclosure. Neither is the "Summary" or "Abstract" to be considered as a characterization of the invention(s) set forth in issued claims.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

It is understood that although a number of different embodiments of the collectible casing card have been illustrated and described herein, one or more features of any one embodiment can be combined with one or more features of one or more of the other embodiments, provided that such combination satisfies the intent of the present invention.

While a number of exemplary aspects and embodiments of the collectible casing card have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A collectible casing card comprising:

a casing member having a casing upper surface;

a card member that is engaged with the casing member to define a casing member interior, the card member having a card upper surface, the casing upper surface being substantially parallel and coplanar to the card upper surface in a flush engagement; and a collectible that is positioned within the casing member interior.

2. The collectible casing card of claim 1 further comprising a fastener that is only secured to the card member.

3. The collectible casing card of claim 2 wherein the fastener includes one of a clamp, a setting, a latch and a clasp.

4. The collectible casing card of claim 2 wherein the fastener is positioned on a side wall of the card member.

5. The collectible casing card of claim 1 wherein the collectible includes a ring.

6. The collectible casing card of claim 1 wherein the collectible includes at least a portion of one of a uniform and sports equipment.

7. The collectible casing card of claim 1 further comprising an image imprinted on a top surface of the card member.

8. The collectible casing card of claim 7 wherein the image includes at least one of written indicia, a photograph, a graphic, a digital image, artwork, a computer-generated image and a sporting logo.

9. The collectible casing card of claim 1 further comprising a base card that is adhered to the casing member.

10. The collectible casing card of claim 1 wherein the fastener is removably secured to one of the casing member and the card member.

11. A collectible casing card comprising:

a casing member having a casing lower surface and a casing side surface;

a card member that is engaged with the casing member to define a casing member interior, the card member having a card upper surface and a card side surface, the casing lower surface being substantially parallel to the card upper surface;

a base card that is adhered to the casing member;

a collectible that is positioned within the casing member interior; and a fastener that is secured to one of the casing member and the card member, the fastener being configured to fasten the collectible.

12. The collectible casing card of claim 11 wherein the card member includes a side wall, and the fastener is secured to the side wall.

13. The collectible casing card of claim 11 wherein the fastener is removably secured to one of the casing member and the card member.

14. The collectible casing card of claim 11 wherein the casing member interior has a rectangular cross-sectional shape.

15. The collectible casing card of claim 11 wherein a majority of the casing member is configured to be positioned between the card member and the base card.

16. The collectible casing card of claim 11 further comprising an image that is one of (i) embossed, and (ii) carved into a top surface of the card member.

17. The collectible casing card of claim 16 wherein the card member surrounds a majority of the image.

18. The collectible casing card of claim 11 wherein the card member is formed from one or more of (i) a cardstock, (ii) a cardboard, (iii) a silk, (iv) a plastic material, and (v) a paper product.

19. The collectible casing card of claim 11 wherein the card member is formed from a plurality of layers of cardstock that are adhered to one another.

20. A collectible casing card comprising:

a casing member;

a base card that is adhered to the casing member;

a collectible that is positioned within the casing member interior;

a card member that is engaged with the casing member to define a casing member interior having a rectangular cross-sectional shape; and a fastener that is secured to one of the casing member and the card member, the fastener being configured to fasten the collectible.

* * * * *